US008730412B2

(12) United States Patent
Hsu et al.

(10) Patent No.: US 8,730,412 B2
(45) Date of Patent: May 20, 2014

(54) DISPLAY APPARATUS AND DISPLAY CONTROL CIRCUIT THEREOF

(75) Inventors: Chih-Fu Hsu, Hsin-Chu (TW); Shih-Hung Hsu, Hsin-Chu (TW); Yang-Hung Shih, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 355 days.

(21) Appl. No.: 13/112,514

(22) Filed: May 20, 2011

(65) Prior Publication Data

US 2011/0304780 A1 Dec. 15, 2011

(30) Foreign Application Priority Data

Jun. 15, 2010 (TW) ..... 99119554 A

(51) Int. Cl.
*G03B 13/00* (2006.01)
*H04N 5/232* (2006.01)

(52) U.S. Cl.
USPC ..... 348/836

(58) Field of Classification Search
USPC ..... 348/836; 377/64; 345/104, 76, 100; 257/72
See application file for complete search history.

(56) References Cited

U.S. PATENT DOCUMENTS

| | | | | |
|---|---|---|---|---|
| 5,600,155 | A * | 2/1997 | Wu | 257/72 |
| 6,891,539 | B1 | 5/2005 | Maruyama et al. | |
| 2006/0114214 | A1 | 6/2006 | Griffin et al. | |
| 2006/0267886 | A1* | 11/2006 | Ozaki et al. | 345/76 |
| 2009/0129534 | A1* | 5/2009 | Yoshida | 377/64 |
| 2009/0195495 | A1* | 8/2009 | Hsu et al. | 345/104 |
| 2009/0295731 | A1 | 12/2009 | Kim et al. | |
| 2011/0025590 | A1* | 2/2011 | Lin et al. | 345/100 |

* cited by examiner

*Primary Examiner* — Dave Czekaj
*Assistant Examiner* — Berteau Joisil
(74) *Attorney, Agent, or Firm* — WPAT, PC; Justin King

(57) ABSTRACT

A display apparatus has a housing, a base, a system board and a display panel. The base is connected to the housing such that the display apparatus is disposed on a flat surface. The system board is disposed in the housing and has a control system for performing an up-down inversing process for an image transmitted from a signal source. The display panel has a timing controller and a pixel array. Specifically, the display panel is put upside down in the housing such that the pixel array is also upside down, and the timing controller is adjacent to the location connecting the base with the housing. The timing controller is coupled to the system board, to perform a left-right mirroring process for the up-down inversed image.

14 Claims, 4 Drawing Sheets

DISPLAY APPARATUS AND DISPLAY CONTROL CIRCUIT THEREOF

BACKGROUND

1. Technical Field

The present invention relates to an image display technology, and more particularly to an image display technology adapted for a display apparatus with an inverted pixel array.

2. Description of the Related Art

In some conditions, a user may need to rotate an image displayed by a display apparatus to make the image be convenient to view. Such as some display regions of some documents or webpage are not wide but long. Therefore, if the documents or the webpage are displayed by an image arranged along a lateral direction, it will be inconvenient to view. Therefore, some display technologies permit the user to rotate the image. The conventional display technologies may be mainly divided into several following means to rotate the image.

The first means is provided to employ an image signal source to directly generate anti-rotated image data, such that the display apparatus can display the rotated image. However, not all kinds of the signal source can generate the anti-rotated image data. For example, when the signal source electrically coupled to the display apparatus is the signal source of the coaxial cable, these signal sources cannot directly generate rotated image data.

A second means is provided to employ a signal source to output normal image data to a display apparatus, and employ a control main chip of a control system of the display apparatus to rotate the received normal image data. While adapting such kind of conventional means, a control main chip needs to access the image data in a register continually, and further needs to pay attention to the vertical accessing direction and the horizontal accessing direction. Therefore, the conventional means is complex, and it is prone to generate errors.

A third means is provided to employ a signal source to output normal image data, and employ a timing controller to rotate the image rather than rotating the image through the control main chip. Since this conventional means needs a register with a frame size to rotate the image, the conventional means must dispose a storage unit with the frame size on the display panel as the register. However, the conventional means will increase the cost of the hardware.

SUMMARY

The present invention relates to a display apparatus, which can display a rotated image.

The present invention also relates to a display control circuit, which can rotate an image by a simple technology and hardware with a low cost.

A display apparatus comprises a housing, a control system and a display panel. The display panel is disposed upside down in the housing and is configured for receiving a video data stream comprising a plurality of video data sub-streams of an image. A first video data sub-stream of the video data sub-streams is configured for forming a top portion of the image, and an m-th video data sub-stream of the video data sub-streams is configured for forming a bottom portion of the image, wherein m being an integral number. The display panel comprises a plurality of data lines, a plurality of scan lines and a timing controller. The scan lines comprise a first scan line and an m-th scan line. The first scan line is configured for transmitting the first video data sub-stream, and the m-th scan line is configured for determining whether or not displaying the m-th video data sub-stream. The timing controller and the m-th scan line are disposed at a side apart from the first scan line. When displaying the image is displayed, the timing controller controls scanning the m-th scan line first so as to display the m-th video data sub-stream, and then scanning the first scan line so as to display the first video data sub-stream. In particularly, the timing controller performs a left-right mirroring process for the image. The system board is also disposed in the housing and has a control system to transmit the video data stream to the display panel, and the control system accesses the video data sub-streams to perform an up-down inversing process for the image.

On the other hand, a display control circuit adapted for a display panel has a pixel array formed by a plurality of pixel units arranged in an array. The display control circuit comprises a storage unit, a control unit and a timing controller. The storage unit is configured for receiving a video data stream having a plurality of video data corresponding to the pixel units respectively. The video data transmitted to the pixel units of the same row of the pixel array form a video data sub-stream. These video data sub-streams are stored into the storage unit in sequence according to a sequence of corresponding rows of the pixel array. Similarly, the video data in each of the video data sub-streams are stored into the storage unit in sequence according to a sequence of columns of the corresponding pixel units. In addition, the control unit is coupled to the storage unit. When the pixel array displays an image rotated 180 degree, the control unit outputs the video data sub-streams in a sequence opposite to the sequence of the rows of the pixel array corresponding to the video data sub-streams. The timing controller has a line register for temporarily storing the output of the control unit. When the pixel array display the image rotated 180 degrees, the timing controller outputs the video data in each of the video data sub-streams in the sequence opposite to the sequence of the columns of the pixel units corresponding to each of the video data in each of the video data sub-streams respectively such that the display apparatus displays the image rotated 180 degrees.

From another viewpoint, a display apparatus comprise a housing, a display panel and a control system. The display panel is disposed upside down in the housing and is configured for receiving a video data stream comprising a plurality of video data sub-streams of an image. A first video data sub-stream of the video data sub-streams is configured for forming a top portion of the image, and an m-th video data sub-stream of the video data sub-streams is configured for forming a bottom portion of the image, wherein m being an integral number. The control system is also disposed in the housing for transmitting the video data stream to the display panel, and accessing the video data sub-streams to perform an upside down inversing process for the image. In addition, the display panel has a plurality of data lines, a plurality of scan lines, and a timing controller. The scan lines has a first scan line and a m-th scan line. The first scan line is configured for transmitting the first video data sub-stream. Additionally, the m-th scan line is configured for transmitting the m-th video data sub-stream. furthermore, the timing controller is disposed at a side apart from the first scan line. Wherein, the scanning lines are controlled by the timing controller to be scanned from the m-th scan line to the first scan line in sequence, and the timing controller performs a left to right mirroring process to the image.

Since the present invention employs the control unit (such as the control main chip) and the timing controller perform the related process of rotating the image 180 degrees. Therefore, the processing technology of the present invention is simple, and it can save the cost of the hardware.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1A:
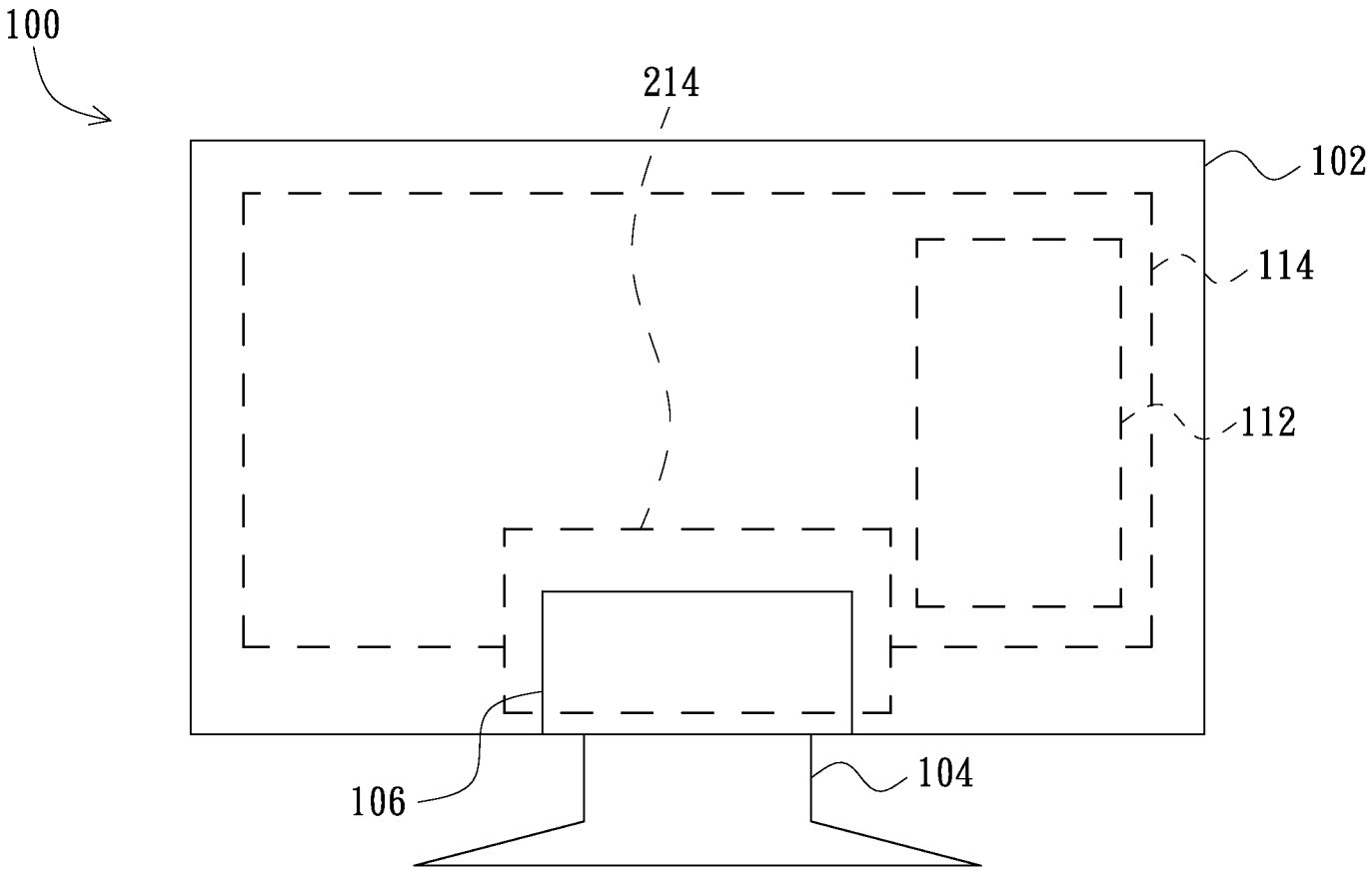
FIG. 1A is a schematic view of a display apparatus in accordance with a preferable exemplary embodiment of the present invention.

FIG. 1A is a schematic view of a display apparatus in accordance with a preferable exemplary embodiment. Referring to FIG. 1A, the display apparatus 100 of the exemplary embodiment comprises a housing 102 and a base 104. The housing 102 further has a connecting portion 106 and the housing 102 is adapted to be connected with the base 104 through a connecting portion 106. Therefore, the display apparatus 100 may be arranged on a flat surface, such as a desktop, by the base 104.

Figure 3:
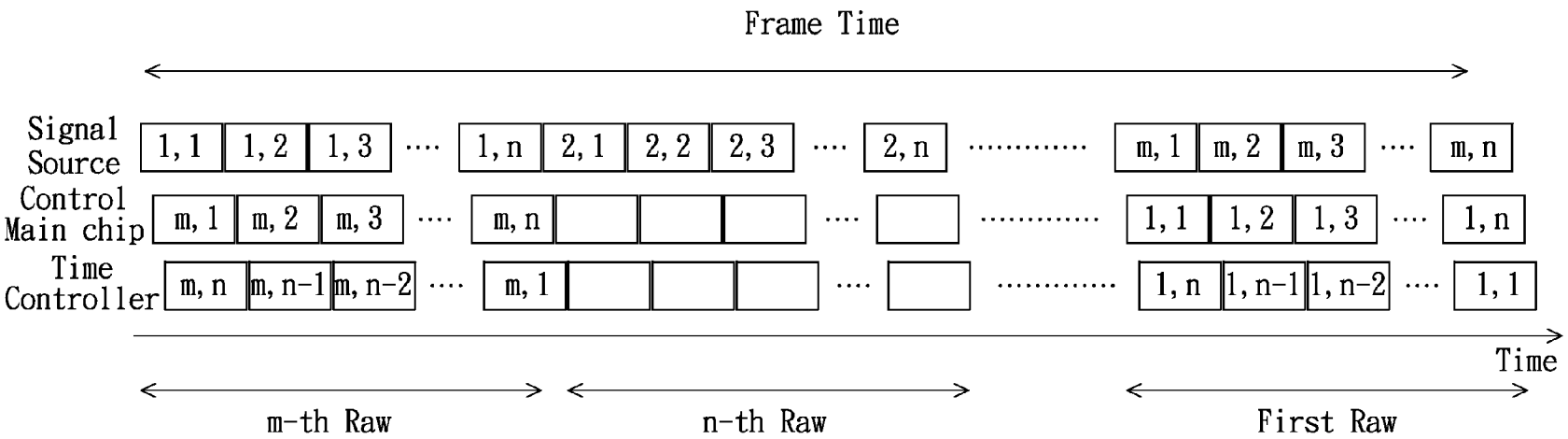
FIG. 3 is a schematic view of a video data stream in accordance with a preferable exemplary embodiment of the present invention.

The display apparatus 100 further comprises a control system 112 and a display panel 114, which are disposed in the housing 102. The control system 112 may be a printed circuit board, which has a control system coupled to the display panel 114. The display panel 114 will receive a video data stream, and the video data stream may comprise a plurality of video data sub-streams (which are described in following). The display panel 114 displays an image according to the video data sub-streams one by one. The video data sub-streams comprise a first video data sub-stream and an m-th video data sub-stream (as shown in FIG. 3). The first video data sub-stream is configured for forming a top portion of the image, and the m-th video data sub-stream is configured for forming a bottom portion of the image.

Figure 1B:
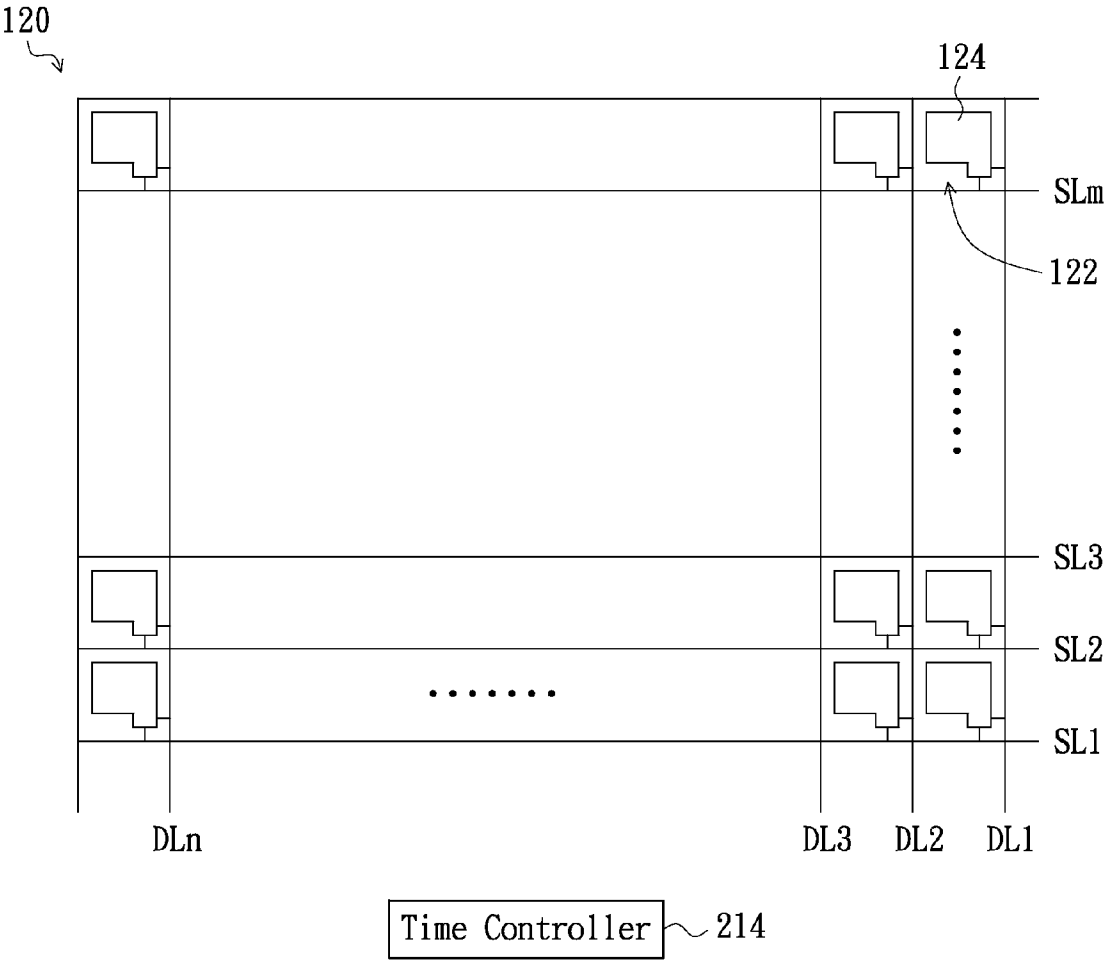
FIG. 1B is a schematic view of a display panel in accordance with a preferable exemplary embodiment of the present invention.

FIG. 1B is a schematic view of a display panel in accordance with a preferable exemplary embodiment of the present invention. Referring to FIGS. 1A and 1B, the display panel 114 comprises a timing controller 214, a plurality of scan lines SL1~SLm and a plurality of data lines DL1~DLn, wherein m and n are both integral number larger than 1. In the exemplary embodiment, the scan lines SL1~SLm and the data lines DL1~DLn are intercrossed in sequence, to form a plurality of pixel spaces 122 arranged in an array. Each of the pixel spaces 122 has a pixel unit 124 disposed therein respectively, which is coupled to a corresponding data line and a corresponding scan line. These pixel units form a pixel array 120.

The scan lines SL1~SLm comprises a first scan line SL1, a second scan line SL2 and an m-th scan line SLm. The pixel units 124 on the first scan line SL1 are configured for displaying the first video data sub-stream, the pixel units 124 on the second scan line SL2 are configured for displaying the second video data sub-stream, and the pixel units 124 on the m-th scan line SLm are configured for displaying the m-th video data sub-stream, and so on. In addition, the first scan line SL1 is configured for transmitting the first video data sub-stream, and the m-th scan line SLm is configured for determining whether or not displaying the m-th video data sub-stream. From FIG. 1 it can be clearly seen that, the timing controller 214 and the m-th scan line SLm are disposed at different sides of the first scan line SL1.

Specifically, in the exemplary embodiment, when the display panel displays the image, the timing controller 214 will control to scan the m-th scan line first so as to display the m-th video data sub-stream, and last scan the first scan line so as to display the first video data sub-stream.

In this exemplary embodiment, the timing controller 214 is disposed at the position near the connecting portion 106. Since the connecting portion 106 has a certain thickness, the displacement of the timing controller would not further increase the thickness of the connection portion 106, and thus the average thickness of the display apparatus 100 may be effectively decreased by this adjustment. Since the display panel 114 is put upside down in the housing, the image displayed by the display panel 114 is an up-down opposite and left-right inversed image.

Figure 2:
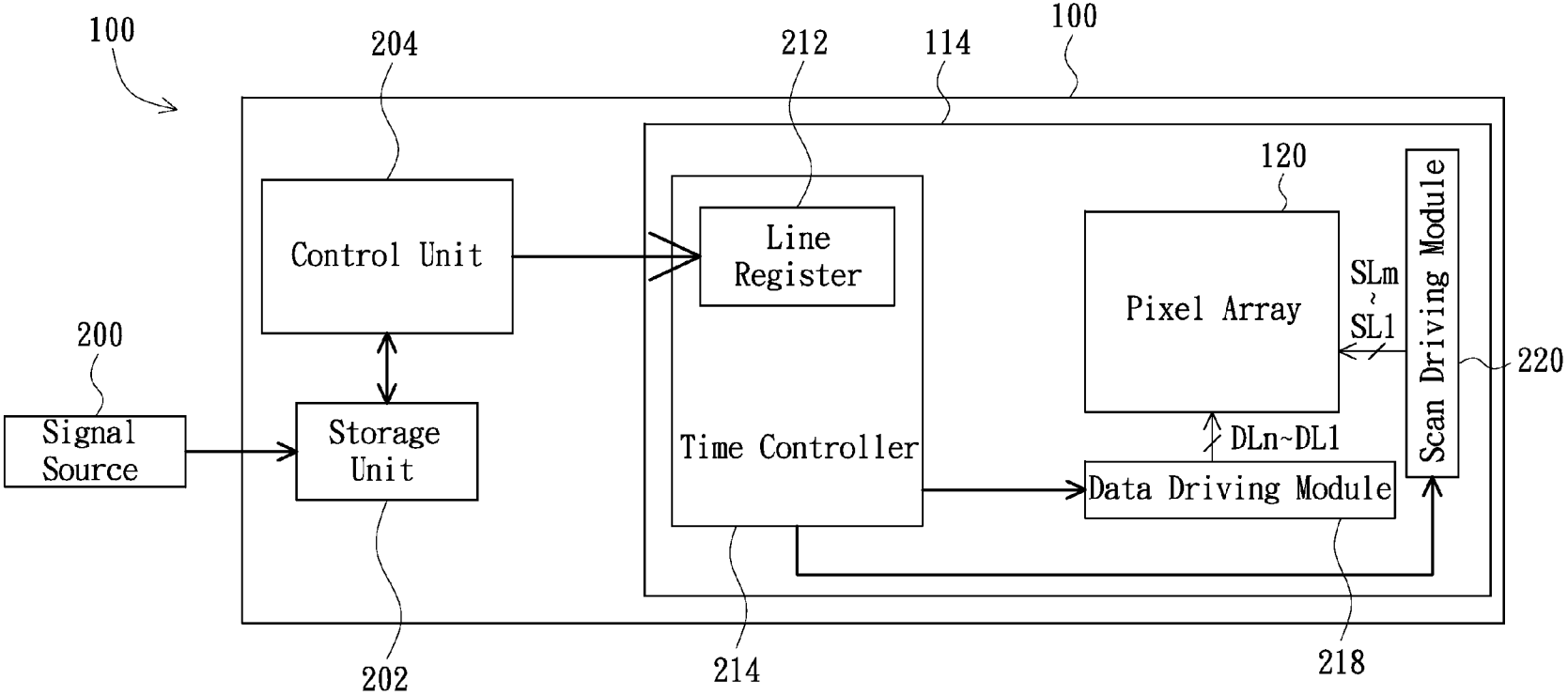
FIG. 2 is a schematic view of a display control circuit in accordance with a preferable exemplary embodiment of the present invention.

FIG. 2 is a schematic view of a display control circuit of a display apparatus in accordance with a preferable exemplary embodiment of the present invention. Referring to FIG. 2, the display apparatus 100 has a storage unit 202 and a control unit 204. The storage unit 202 may receive the video data stream outputted from a signal source 200, such as a display card or a coaxial cable, and the storage unit 202 is also coupled to the control unit 204 (such as a control main chip). In addition, the control unit 204 is further coupled to the display panel 114.

The timing controller 214 may be coupled to the control unit 204, and have a line register 212. In addition, the line register 212 is configured for receiving and temporarily store the output of the control unit 204.

In addition, the display panel 114 further comprises a data driving module 218 and a scan driving module 220. The data driving module 218 is coupled to the pixel array 120 through the data lines DLn~DL1, and the scan driving module 220 is coupled to the pixel array 120 through the scan lines SLm~SL1. In the exemplary embodiment, the display panel 114 is upside down such that the pixel array 120 is also upside down to rotate the image 180 degrees which is displayed by the display panel 114 when comparing with the image originally outputted from the signal source 200. Therefore, in the exemplary embodiment, when the signal source 200 transmits the video data stream to the display apparatus 100, the video data stream is stored in the storage unit 202 first. Meanwhile, the control unit 204 will access the video data stream in the storage unit 202, and perform the upside down inversing process for the image which should be displayed by the pixel array 216. Then the line register 212 would temporarily store the output of the control unit 204, such that the timing controller 214 performs the left to right mirroring process for the upside down inversed image. Thus the user can view the normal image from the display panel. The above description will be described detail in following.

FIG. 3 is a schematic view of a video data stream in accordance with a preferable exemplary embodiment of the present invention. Referring to FIGS. 1B, 2 and 3, the signal source 200 outputs a video data stream in each frame time. The video data stream comprises a plurality of video data corresponding to each of the pixel units of the pixel array 120 respectively. For example, the video data of the number (1, 1) corresponds to the pixel unit 124 of the first row (that is the first scan line SL1) and the first column (that is the first data line DL1) of the pixel array 120; the video data of the number (m, 1) corresponds to the pixel unit 124 of the m-th row (that is the m-th scan line SLm) and the first column of the pixel array 120; the video data of the number (m, n) corresponds to the last pixel unit 124 of the pixel array 120, that is the pixel unit 124 of the m-th row and the n-th column (that is the n-th data line DLn), and so on.

Furthermore, in the same frame time, a video data sub-stream consists of the video data transmitted to the same row (the same scan line) of the pixel array 120. These video data sub-streams are transmitted in sequence according to the sequence of the corresponding rows from the signal source 200 for being temporarily stored in the storage unit 202. Meanwhile, the video data in each of the video data sub-stream are transmitted to the storage unit 202 in sequence according to the sequence of the columns of the corresponding pixel units.

After all of the video data in the same frame time are stored in the storage unit 202, the control unit 204 outputs the video data sub-streams in a sequence opposite to the sequence of the rows of the pixel array 216 corresponding to the video data sub-streams. In detail, the control unit 204 firstly outputs the video data sub-stream corresponding to the pixel units of the m-th row of the pixel array 216, then outputs the video data sub-stream corresponding to the pixel units of the m-1-th row of the pixel array 216, and so on. Finally, the control unit 204 outputs the video data sub-stream corresponding to the pixel units of the first row of the pixel array 216. Therefore, the control unit 204 completes the up-down inversing process for the image. In the exemplary embodiment, due to the control unit 204 only to inverse the image upside down, thus the complexity of the control unit is lower, and the performed process is easier.

Then, the video data sub-streams outputted from the control unit 204 are temporarily stored in the line register 212 to wait for being accessed by the timing controller 214. In the exemplary embodiment, the timing controller 214 outputs the video data to the data driving module 218 in a sequence opposite to the sequence of the columns of the pixel units corresponding to the video data, then the data driving module 218 transmits the video data from the timing controller 214 to the pixel array 216 through the data lines DL1 to DLn for driving the corresponding pixel units. Thus it can complete the left to right mirroring process for the image. Since the timing controller 214 only needs to process the video data in a single video data sub-stream once, the line register 212 has a memory size enough storing the data of a single line, thus it will not increase the cost of the hardware.

In summary, the timing controller of the present invention is adjacent to the location connecting the display apparatus with the base, thus the present invention can decrease the average thickness of the display apparatus. In addition, since the control unit and the timing controller only need to perform the up-down inversing process and the left-right mirroring process respectively, it can simplify the related processes and decrease the cost of the hardware. Simultaneously, it also can make the display apparatus display the normal display.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A display apparatus, comprising:

a housing;

a display panel, disposed upside down in the housing and configured for receiving a video data stream comprising a plurality of video data sub-streams of an image, a first video data sub-stream of the video data sub-streams being configured for forming a top portion of the image, an m-th video data sub-stream of the video data sub-streams being configured for forming a bottom portion of the image, m being an positive integer, the display panel comprising:

a plurality of data lines;

a plurality of scan lines, comprising a first scan line and an m-th scan line; and a timing controller, disposed at a side apart from the first scan line, when the image is displayed, the timing controller controls scanning the m-th scan line first to display the m-th video data sub-stream, and scanning the first scan line last to display the first video data sub-stream, the timing controller further performs a left-right mirroring process for the image; and a control system, disposed in the housing, for transmitting the video data stream to the display panel and accessing the video data sub-streams to perform an up-down inversing process for the image;

wherein the control system comprises:

a storage unit for receiving the video data stream, wherein each of the video data sub-streams of the video data stream corresponds to one row of the pixel units of the pixel array respectively, such that the video data sub-streams are stored into the storage unit in sequence according to a sequence of the rows of the pixel array; and a control unit, coupled to the storage unit for outputting the video data sub-streams in an inverse sequence according to a sequence of the video data sub-streams corresponding to the rows of the pixel array to complete the up-down inversing process for the image;

wherein the timing controller has a line register coupled to the control system, the line register is configured for receiving the video data sub-streams outputted from the control unit, and each of the video data sub-streams has a plurality of video data corresponding to the pixel units of a corresponding row of the pixel array respectively, the timing controller outputs the video data in each of the video data sub-streams in a sequence opposite to the sequence of the columns of the pixel units corresponding to the each of the video data in each of the video data sub-streams to complete the left-right mirroring process for the image.

2. The display apparatus as claimed in claim 1, wherein the data lines and the scan lines are intercrossed with each other to form a plurality of pixel units arranged in an array, the plurality of pixel units are coupled to corresponding data lines and corresponding scan lines respectively to form a pixel array.

3. The display apparatus as claimed in claim 1, further comprising a base connected to the housing for the display apparatus to be disposed on a flat surface.

4. The display apparatus as claimed in claim 3, wherein the timing controller of the display panel is disposed near the base.

5. A display control circuit, adapted for a display panel having a pixel array formed by a plurality of pixel units arranged in an array, the display control circuit comprising:

a storage unit, for receiving a video data stream having a plurality of video data corresponding to the pixel units respectively, a video data sub-stream consisting of the video data to be transmitted to the pixel units at the same row of the pixel array, wherein video data sub-streams are stored into the storage unit in sequence according to a sequence of corresponding rows of the pixel array, the video data in each of the video data sub-streams are stored into the storage unit in sequence according to a sequence of columns of the corresponding pixel units;

a control unit, coupled to the storage unit for outputting the video data sub-streams in a sequence opposite to the sequence of the rows of the pixel array corresponding to the video data sub-streams when the pixel array displays an image to be rotated in 180 degree; and a timing controller coupled to the control unit, the timing controller having a line register configured for receiving the video data sub-streams outputted from the control unit in sequence, wherein when the pixel array displays the image to be rotated in 180 degrees, the timing controller outputs the video data in each of the video data sub-streams in the sequence opposite to the sequence of the columns of the pixel units corresponding to each of the video data in each of the video data sub-streams respectively.

6. The display control circuit as claimed in claim 5, further comprising:

a scan driving module coupled to the timing controller for enabling the pixel units at each row of the pixel array; and a data driving module coupled to the timing controller for transmitting the video data outputted from the timing controller to each of the pixel units of the corresponding row of the pixel array, for driving the pixel array to display the image.

7. A display apparatus, comprising:

a housing;

a display panel configured for receiving a video data stream comprising a plurality of video data sub-streams of an image, a first video data sub-stream of the video data sub-streams being configured for forming a top portion of the image, an m-th video data sub-stream of the video data sub-streams being configured for forming a bottom portion of the image, m being an positive integer, the display panel comprising:

a plurality of data lines;

a plurality of scan lines, comprising a first scan line and an m-th scan line, wherein the first scan line is configured for transmitting the first video data sub-stream, and the m-th scan line is configured for transmitting the m-th video data sub-stream; and a timing controller, disposed at a side apart from the first scan line, wherein the scanning lines are controlled by the timing controller to be scanned from the m-th scan line to the first scan line in sequence, and the timing controller performs a left to right mirroring process to the image; and a control system, disposed in the housing, for transmitting the video data stream to the display panel and accessing the video data sub-streams to perform an upside down inversing process for the image;

wherein the control system comprises:

a storage unit for receiving the video data stream, wherein each of the video data sub-streams of the video data stream corresponds to one row of the pixel units of the pixel array respectively, such that the video data sub-streams are stored into the storage unit in sequence according to a sequence of the rows of the pixel array; and a control unit, coupled to the storage unit for outputting the video data sub-streams in an inverse sequence according to a sequence of the video data sub-streams corresponding to the rows of the pixel array to complete the up-down inversing process for the image;

wherein the timing controller has a line register coupled to the control system, the line register is configured for receiving the video data sub-streams outputted from the control unit, and each of the video data sub-streams has a plurality of video data corresponding to the pixel units of a corresponding row of the pixel array respectively, the timing controller outputs the video data in each of the video data sub-streams in a sequence opposite to the sequence of the columns of the pixel units corresponding to the each of the video data in each of the video data sub-streams to complete the left-right mirroring process for the image.

8. The display apparatus as claimed in claim 7, wherein the data lines and the scan lines are intercrossed with each other to form a plurality of pixel units arranged in an array, the plurality of pixel units are coupled to corresponding data lines and corresponding scan lines respectively to form a pixel array.

9. The display apparatus as claimed in claim 7, further comprising a base connected to the housing for the display apparatus to be disposed on a flat surface.

10. The display apparatus as claimed in claim 9, wherein the timing controller of the display panel is disposed near the base.

11. The display apparatus as claimed in claim 10, wherein the timing controller and the m-th scan line are disposed at different sides of the first scan line.

12. The display apparatus as claimed in claim 11, wherein the first scan line is disposed nearer the base than the m-th scan line.

13. The display apparatus as claimed in claim 4, wherein the timing controller and the m-th scan line are disposed at different sides of the first scan line.

14. The display apparatus as claimed in claim 13, wherein the first scan line is disposed nearer the base than the m-th scan line.

* * * * *